United States Patent [19]

Hammond et al.

[11] 4,071,799

[45] Jan. 31, 1978

[54] SODIUM VAPOR LAMP WITH EMISSION APERTURE

[75] Inventors: Thomas J. Hammond, Penfield; William L. Lama, Webster, both of N.Y.

[73] Assignee: Xerox Corporation, Stamford, Conn.

[21] Appl. No.: 783,904

[22] Filed: Apr. 1, 1977

[51] Int. Cl.[2] ..... H01J 61/52

[52] U.S. Cl. ..... 313/44; 313/17; 313/46; 313/227; 313/113

[58] Field of Search ..... 313/11, 17, 18, 34, 313/44, 46, 113

[56] References Cited

U.S. PATENT DOCUMENTS 3,821,578 6/1974 Beck et al. ..... 313/44

*Primary Examiner*—Rudolph V. Rolinec
*Assistant Examiner*—Darwin R. Hostetter
*Attorney, Agent, or Firm*—Robert J. Bird

[57] ABSTRACT

A low pressure sodium vapor lamp including a sodium vapor discharge tube and a light reflector partially surrounding the discharge tube and defining a light transmission aperture for desired directional light output. The light reflector is in tangential contact with the discharge tube on the surface thereof opposite to the light aperture. The contact between discharge tube and light reflector provides a thermal coupling for heat conduction from the discharge tube. The area of this thermal coupling thus becomes the coolest portion of the discharge tube, the "cold spot" of the lamp where excess sodium is condensed.

3 Claims, 1 Drawing Figure

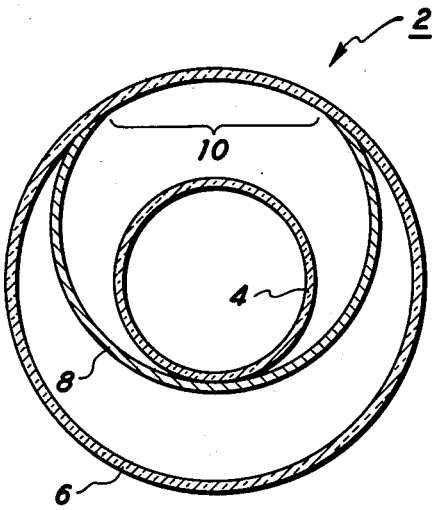
2
10
4
8
6

SODIUM VAPOR LAMP WITH EMISSION APERTURE

BACKGROUND OF THE INVENTION

This invention relates to sodium vapor lamps and in particular to a low pressure sodium vapor lamp for use as a xerographic exposure lamp.

Low pressure sodium vapor lamps have several desirable properties for application as exposure lamps in xerographic photocopiers. The spectral output of sodium lamps is almost monochromatic, emitting essentially at 589.0 and 589.6 nanometers, this in the yellow portion of the spectrum. As has been pointed out in U.S. Pat. No. 3,689,205, this yellow radiation is particularly desirable for creating object contrast for copying of most documents and the paper work in general use. Furthermore, the efficiency of low pressure sodium lamps is relatively high and compares favorably with other linear light sources.

For xerographic application, there are certain characteristics of sodium lamps that present problems to be overcome. Excess metallic sodium is generally present within the lamp discharge tube to control the vapor pressure within the tube. This metallic sodium is opaque and absorbs some of the radiation from the sodium vapor discharge and to that extent lowers the lamp efficiency. Also, for most xerographic applications, it is desirable to direct the light emission from the exposure lamps onto a rectangular slit to minimize stray light.

In the prior art, as for example U.S. Pat. No. 3,221,198 to Van der Wal et al, the coating of a sodium vapor lamp tube with tin oxide for the purpose of visible transmission and infrared reflection, for the purpose of heat conservation, is known.

It is an object of the present invention to provide a sodium vapor discharge lamp with a combination light reflector, defining a light aperture to provide desired directionality of visible light emission, and heat sink to define and locate the lamp "cold spot" where excess sodium is condensed.

SUMMARY OF THE INVENTION

This invention is practiced in one form by a low pressure sodium vapor lamp including a sodium vapor dishcarge tube and a light reflector partially surrounding the discharge tube and defining a light transmission aperture for desired directional light output. The light reflector is in tangential contact with the discharge tube on the surface thereof opposite to the light aperture. The contact between discharge tube and light reflector provides a thermal coupling for heat conduction from the discharge tube. The area of this thermal coupling thus becomes the coolest portion of the discharge tube, the "cold spot" of the lamp where excess sodium is condensed.

For a better understanding of this invention, reference is made to the following detailed description of an exemplary embodiment, given in connection with the accompanying drawing.

DRAWING

The single drawing FIGURE is a schematic cross section of a low pressure sodium vapor lamp according to the present invention.

DESCRIPTION

Referring to the drawing, a sodium vapor discharge lamp is generally indicated in cross section at 2 and includes an inner discharge tube 4 within an outer transparent envelope 6. The glass inner discharge tube 4 contains sodium which, during lamp operation, may be in both vapor and condensed phases. A tubular reflector 8, defining a longitudinal light aperture 10 along the length of the lamp, partially surrounds the discharge tube 4. Reflector 8 is in tangential contact with the discharge tube 4 on the surface thereof opposite to the light aperture 10. The contact between discharge tube and light reflector provides a thermal coupling for heat conduction from the discharge tube. The light reflector 8 thus acts also as a heat sink. The area of the thermal coupling of discharge tube 4 and light reflector-heat sink 8 becomes the coolest portion of the discharge tube, the "cold spot" of the lamp where excess sodium is condensed.

In operation, the sodium discharge lamp 2 functions in a known way to emit light in the inner discharge tube 4 by passage through vaporized sodium of an electric discharge. The excess of metallic sodium within the discharge tube 4, functions to control the vapor pressure within the tube. Excess metallic sodium will condense at the coolest part of the discharge tube 4. In order to keep the optical path to the light aperture 10 clear of condensed sodium, the coolest part of the discharge tube is located in the opposite direction, i.e. at the thermal coupling of discharge tube and light reflector.

Light reflector and heat conductor 8 is presently considered as being a metallic member as for example of aluminum. However, this is not essential. It could be made of glass with a suitable light reflective coating such as titanium dioxide, barium sulfate or magnesium oxide.

The foregoing description of certain embodiments of this invention is given by way of illustration and not of limitation. The concept and scope of the invention are limited only by the following claims and equivalents thereof which may occur to others skilled in the art.

What is claimed is:

1. A sodium vapor discharge lamp including a sodium vapor discharge tube and a light reflector extending along and partially surrounding said discharge tube, said light reflector defining a light source aperture for the transmission therethrough of visible light in a desired direction, said light reflector being in contact with said discharge tube on a surface thereof away from said light aperture, said contact effecting a thermal coupling of said discharge tube and said light reflector for the conduction of heat through said thermal coupling from said discharge tube to said light reflector, thereby to locate the coolest area of said discharge tube at the area of said contact, where any sodium condensation occurs, away from said light aperture.

2. A sodium vapor discharge lamp as defined in claim 1 in which said light reflector is metallic.

3. A sodium vapor discharge lamp as defined in claim 1 in which said light reflector is glass.

* * * * *